United States Patent [19]

Fletcher et al.

[11] 4,051,877

[45] Oct. 4, 1977

[54] GAS COMPRESSION APPARATUS

[76] Inventors: James C. Fletcher, Administrator of the National Aeronautics and Space Administration, with respect to an invention of; Leslie S. Terp, Scottsdale, Ariz.

[21] Appl. No.: 625,734

[22] Filed: Oct. 24, 1975

[51] Int. Cl.[2] ..... B65B 57/00; F04B 17/00

[52] U.S. Cl. ..... 141/4; 60/560; 60/574; 141/197; 417/225

[58] Field of Search ..... 137/211.5; 141/1, 4, 141/39, 46, 392, 197; 417/225; 60/407, 547, 560, 574, 581

[56] References Cited

U.S. PATENT DOCUMENTS 2,080,695 5/1937 Cargile ..... 417/225

*Primary Examiner*—Richard E. Aegerter
*Assistant Examiner*—Frederick R. Schmidt
*Attorney, Agent, or Firm*—Carl O. McClenny; John R. Manning; Marvin F. Matthews

[57] ABSTRACT

Apparatus for transferring gas from a first container to a second container of higher pressure comprising a free-piston compressor having a driving piston and cylinder, a smaller diameter driven piston and cylinder, and a rod member connecting the driving and driven pistons for mutual reciprocation in their respective cylinders. A conduit may be provided for supplying gas to the driven cylinder from the first container. Also provided is control apparatus for intermittently introducing gas to the driving piston, from the first container, to compress gas by the driven piston for transfer to the second higher pressure container.

16 Claims, 3 Drawing Figures

GAS COMPRESSION APPARATUS

BACKGROUND OF THE INVENTION

1. Field of the Invention

The present invention pertains to gas compression apparatus. In particular, it pertains to compressor apparatus of the free-piston type which utilizes gas in a driving or motor cylinder to compress gas in a driven or compression cylinder. More specifically, the present invention pertains to a free-piston type gas compressor of an improved and simplified design requiring a relatively low rate of gas consumption for use by the driving or motor portion.

2. Description of the Prior Art

The United States and other countries in their space programs have sought means to allow spacement to perform activities outside of the vehicles in which they are traveling through space. In the past, such extravehicular activities required the use of an umbilical cord from the vehicle to supply the spaceman with oxygen and other items necessary to support life. The umbilical cord limits the mobility of the spacemen and may create problems in design, manufacture and operation.

Recently, means have been sought to eliminate the umbilical cord. In one concept, a self-contained life support system utilizing high-pressure oxygen bottles in a manner similar to Scuba equipment for underwater divers has been proposed. If such a system is utilized, it is desirable to fill the oxygen bottles from a common source, such as the cabin oxygen supply. However, since the pressure of the cabin oxygen supply is typically 900 psia and the pressure required for the extravehicular activity oxygen bottles may be 4000 psia, some means of compression must also be provided. With the limited space and weight requirements of space vehicles and the limited energy available, the free-piston type compressor appears to offer certain advantages in compressing and transferring gas from one container to higher pressure containers.

Free-piston pumps or compressors are well known. Such pumps or compressors generally comprise a driving or motor piston or cylinder and a driven compressor piston and cylinder of smaller diameter. The pistons are connected by a rod member for mutual reciprocation within their respective cylinders. Fluid, gas or liquid, is generally supplied from a fluid source to the driving cylinder. Filling of the cylinder by mere displacement or expansion of the driving fluid forces the driving piston, and consequently the driven piston, through a cycle in which fluid is displaced and possibly compressed in the driven cylinder for transfer to a second location. Of course, one of the advantages of a free-piston type compressor is that its energy is provided by the fluid which it pumps or compresses, rather than requiring an outside energy source such as electricity or mechanical energy from an internal combustion engine or the like.

Examples of free-piston type pumps or compressors may be seen in U.S. Pat. Nos. 2,750,753 and 3,154,928. However, in each these devices, thermal energy must be provided to create the gas expansion required for operation of the pump or compressor. This requires an outside energy source.

U.S. Pat. No. 3,234,746 discloses a free-piston type gas pump which does not require thermal energy. However, in this device the free-piston apparatus merely transfers fluid from one storage container to another without an increase in the pressure thereof. Thus, its application is limited merely to a transfer function.

SUMMARY OF THE PRESENT INVENTION

In the present invention, a free-piston type compressor is provided for utilization of the space vehicle cabin oxygen supply to compress and transfer oxygen to the higher pressure bottles or containers for use in extravehicular activities. In a typical application, the cabin oxygen may be supplied from cryogenic storage containers at a flow of approximately 1.25 pounds per hour and a pressure of 900 psia. Ideally, a free-piston type compressor for compressing and transferring gas to the extravehicular life-support system would take the required cabin flow for use by its driving or motor piston and then exhaust the expanded gas into the cabin for cabin use. Since the required cabin flow is relatively low, a unique design is necessitated.

In the present invention gas is first supplied from the cabin oxygen source to a capacitance chamber where it is stored until the energy build-up is sufficient to initiate a compression cycle. A control device may be connected between the capacitance chamber and the driving piston and cylinder for intermittently releasing the accumulated gas from the capacitance chamber for introduction into the driving cylinder. The gas then expands, in a substantially adiabatic cycle, moving the driving and the connected driven pistons through the compression cycle. The gas within the driven cylinder is thus compressed and transferred to the higher pressure containers for extravehicular activities. On the return cycle, the expanded gas within the driving cylinder may be released into the cabin for use therein.

Thus, the potential energy of the cabin oxygen supply is utilized to drive the free piston compressor for the necessary compression and transfer function required by the self-contained extravehicular life support system. The apparatus is relatively light in weight, simple to manufacture and operate, requiring a minimum of control devices. Many other objects and advantages of the invention will be apparent from a reading of the specification which follows in conjunction with the accompanying drawings.

DESCRIPTION OF PREFERRED EMBODIMENTS

Figure 1:
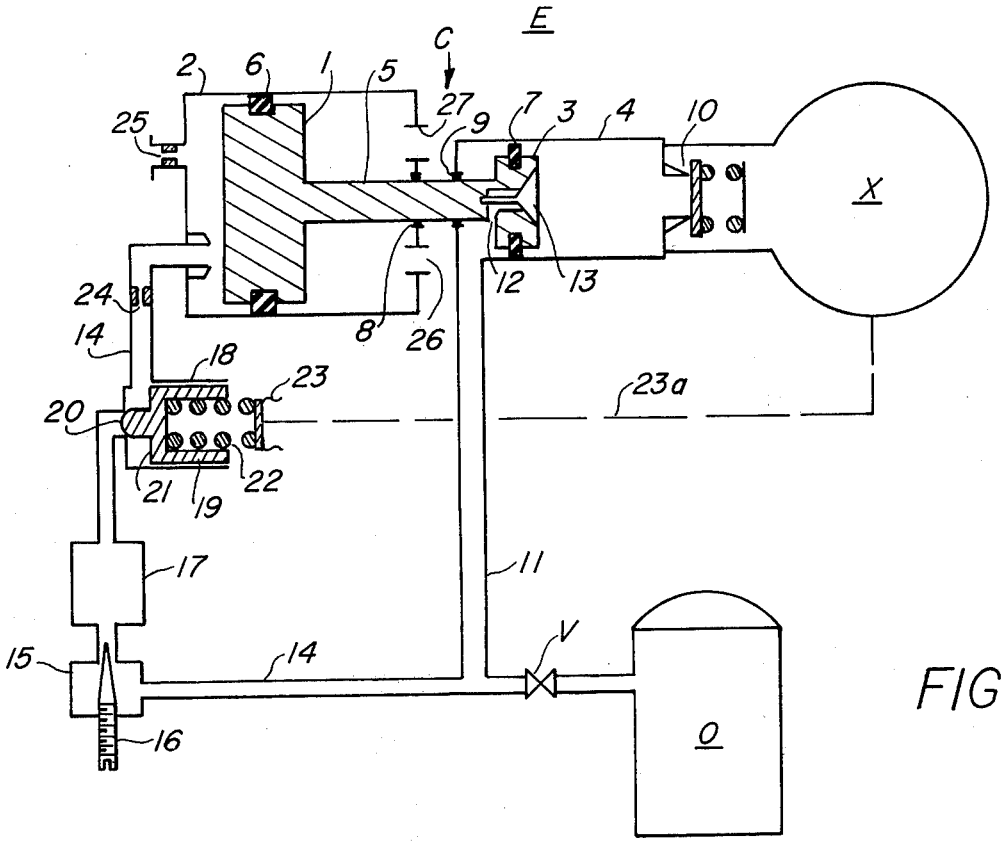
FIG. 1 is a schematic representation of gas transfer and compression apparatus according to a preferred embodiment of the invention.

Referring first to FIG. 1, there is shown a gas transfer and compression system according to a preferred embodiment of the invention. It is assumed that the entire system is borne by a space vehicle within the enclosed environment E thereof. The space vehicle may be provided with a cryogenic oxygen supply O which may, for example, contain oxygen at a pressure of 900 psia.

In the embodiment shown, a free piston compressor C is utilized to compress and transfer oxygen from the cabin supply O to a higher pressure container X for use in an extravehicular life support system. A typical pressure for the container X is 4000 psia.

The free-piston compressor C may comprise a driving or motor piston 1 and cylinder 2 and a driven or compressor piston 3 and cylinder 4 of a smaller diameter. The pistons 1 and 3 may be connected by a rod member 5 for mutual reciprocation in their respective cylinders between a first terminal position, as shown in FIG. 1, and a second terminal position at the opposite ends of the cylinders. Each of the pistons 1 and 3 is provided with suitable sliding seals 6 and 7 respectively. Suitable seals 8 and 9 are also provided between the ends of the cylinders and the rod member 5.

It will be noted that the compressor cylinder 4 communicates with the container X through a check valve 10 of any suitable type which permits flow from the cylinder 4 into the container X, but prevents reverse flow therethrough.

In the embodiment of FIG. 1, the cabin gas supply O is connected, via valve V, through conduit 11 to the rod side of compression cylinder 4. A port or passage 12 and check valve 13 permit gas flowing through the conduit 11 to enter the opposite end of the compressor cylinder 4, the check valve 13 preventing flow in the reverse direction.

The cabin gas supply O is also connected, via conduit 14 and various control devices to be discussed hereafter, to the driving or motor cylinder 2. To assure that driving gas is supplied at a proper rate, a metering valve 15 may be provided. Such a valve may be provided with a manually operable stem 16 for adjusting the flow rate through the system.

Downstream from the metering device 15 is a capacitance chamber 17. With the relatively low flow rates anticipated, such a chamber 17 is necessary to store or accumulate the energy required to operate the free-piston compressor C. As gas is fed through the metering valve 15, it is accumulated within the capacitance chamber 17 until the necessary energy build-up is achieved.

An automatic cycle control valve 18 is provided between the capacitance chamber 17 and driving cylinder 2. Several types of control valves may be suitable. The one shown is provided wih a closure member 19 having a first pressure area 20 and a second pressure area 21. When seated, the first pressure area 20 is the only area exposed to the pressure in capacitance chamber 17. However, when the valve opens, the additional pressure area 21 is also exposed to this pressure. The closure member 19 may be biased toward its closed position by spring member 22. It may also be provided with a pressure diaphragm 23 in communication, through conduit 23*a*, with the high pressure container X. Thus, the valve 18 may be made responsive, for its operation, to the differential pressure between container X and the pressure within capacitance chamber 17.

After the valve 18, conduit 14 continues to the driving cylinder 2. A back pressure orifice 24, the purpose of which will be more fully described hereafter, may be provided in the conduit 14 at this point. An exhaust vent in cylinder 2 may be provided with a suitable exhaust control device such as orifice 25. The rod end of the cylinder 2 may be continuously vented to the cabin environment E by ports 26 and 27.

In operation, gas from the storage container O is introduced to the compression cylinder 4 via conduit 11, port 12 and check valve 13. At the same time, driving gas is supplied to the driving or motor piston, via conduit 14, metering valve 15, capacitance chamber 17 and control valve 18. As the gas is metered through the metering device 15 at a substantially constant rate, it accumulates in the capacitance chamber 17 until the required energy is built up.

At this point, the pressure differential between pressure area 20 and container X, as sensed by diaphragm 23, causes the closure member 19 of the cycle valve 18 to open. Immediately upon opening, the second pressure area 21 is exposed to the pressure within the capacitance chamber 17, accelerating the opening of the valve and assuring that it remains open during a complete cycle. To this end, the orifice 24 also assures that an elevated pressure is maintained on the valve 18 for a period of time necessary for the compressor C to complete its compression cycle.

As the gas enters the driving cylinder 2, it expands, substantially adiabatically, moving the driving or motor piston 1 from its first terminal position to its second terminal position, essentially at the opposite end of the cylinder 2. Of course, as the piston 1 moves, the smaller compression piston 3 moves from its first terminal position to its second terminal position compressing the gas within the cylinder 4 and transferring it via check valve 10 to the high pressure container X.

At the end of the compression cycle, the pressure within the cylinder 2 will have decreased to a value which will allow the control valve 18 to again close. The pressure within the cylinder 4 will force the pistons 3 and 1 to return to their first terminal positions. As this is done, the expanded gas within the driving or motor cylinder 2 will exit through the vent orifice 25 into the cabin environment E for use therein. The cycle is then repeated.

Figure 2:
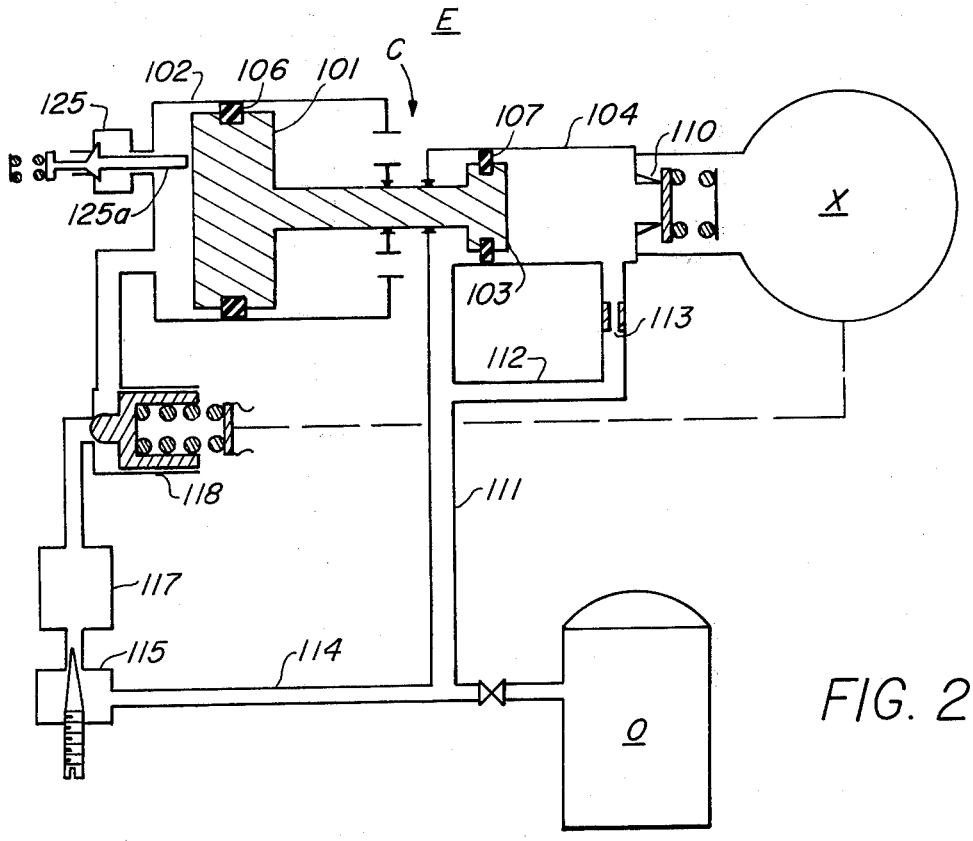
FIG. 2 is a schematic representation of gas transfer and compression apparatus according to an alternate embodiment of the invention.

In FIG. 2, an alternate embodiment of the invention is shown. The components are substantially the same as shown in the embodiment of FIG. 1 and components which correspond with those in the embodiment of FIG. 1 are indicated by adding "100" to the reference numbers thereof. The essential differences lie in the supply manifolding of compression cylinder 104 and the exhausting of driving cylinder 102.

In the alternate embodiment, the conduit 111, supplying gas to the compression cylinder 104, is provided with a branch 112 and orifice 113 which serve essentially the same purpose as port 12 and check valve 13 of the previously discussed embodiment. This eliminates the need for an internal passage through the piston 103 for supplying gas to the compression chamber 104. The orifice 113 acts as a pressure control during the compression chamber cycle to prevent substantial return of gas to the system.

The valve 125 of driving cylinder 102 serves essentially the same function as the orifices 24 and 25 of the previously discussed embodiment. The valve 125 is designed to stay closed during the compresson or expansion cycle of the compressor C. After expansion is completed and pressure within the cylinder 102 falls to a relatively low level, say 25 psia, the valve is forced open, by its spring, allowing the expanded gas to exit into the cabin environment E. Upon return of the motor piston 101 to its first terminal position, the closure member 125*a* is contacted and forced into its closed position, positioning the valve for the next cycle.

Figure 3:
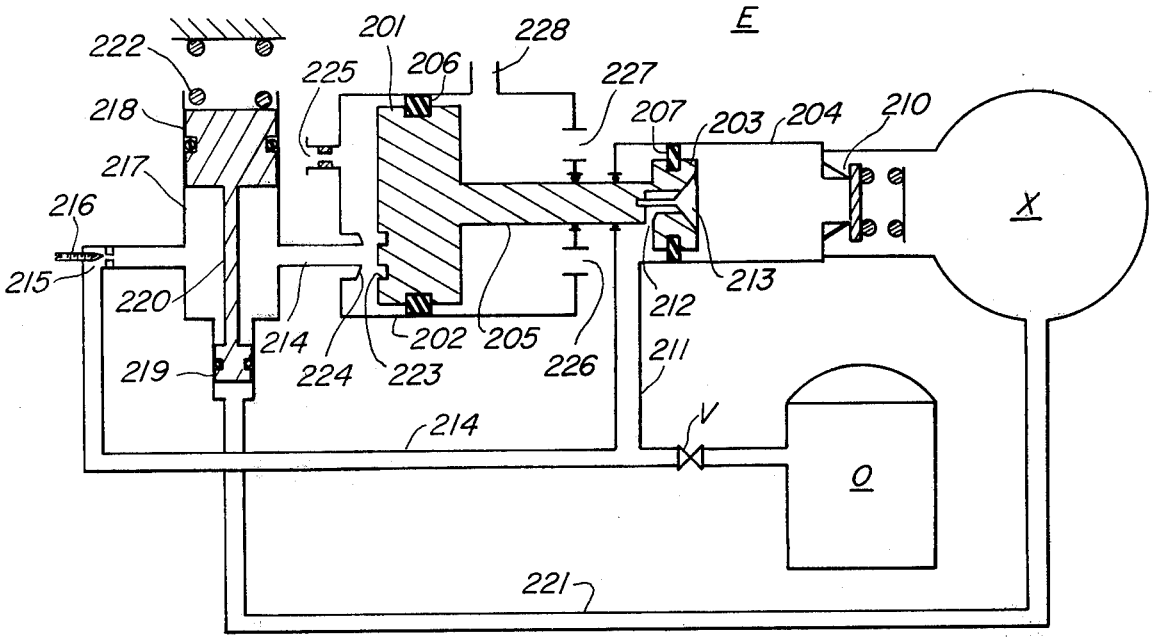
FIG. 3 is a schematic representation of gas transfer and compression apparatus according to still another embodiment of the invention.

FIG. 3 illustrates still another alternate embodiment of the invention which is essentially a version of the embodiment of FIG. 1, but with an improved apparatus for managing or controlling the input of energy to the motor end of the compressor C. Components which correspond with those in the embodiment of FIG. 1 will be indicated by adding "200" to the reference numbers thereof.

Like in the embodiment of FIG. 1, the cabin gas supply O is connected, via valve V, through conduit 211 to the rod side of compression cylinder 204. A port or passage 212 and check valve 213 permit gas flowing through the conduit 211 to enter the opposite end of the compressor cylinder 204, the check valve 213 preventing flow in the reverse direction.

The cabin gas supply O is also connected, via conduit 214 and various control apparatus, to the driving or motor cylinder 202. A metering valve 215, which may have a manually operable stem 216, is provided for adjusting the flow rate through the system.

In the previously discussed embodiment of FIG. 1, a fixed capacitance chamber 17 and variable feedback mechanism 18 were provided to control the energy input to the compressor as a function of the pressure in the high pressure container X. In the improved version of FIG. 3, feedback and pressure release is simplified so that the force used to return the motor piston 201 is also used to set the capacitance release pressure. Thus, the release pressure becomes a function of the pressure to be compressed.

To implement this method of control, a two diameter capacitance chamber 217 is provided with a large piston 218 and small piston 219 connected by rod 220. One end of the small piston 219 is subjected, via conduit 221, to the high pressure in container X. The end of the piston 218 opposite rod 220 rests against and is biased by a spring or other biasing means 222. Thus, the capacitance chamber now becomes variable as a function of the pressure within container X, the pistons 218 and 219 and biasing means 222 being selected so that the capacitance varies to provide exactly the energy needed for each compression cycle. The variable capacitance also has an additional advantage to the system which uses variable pressure, in that variable pressure capacitance release is not linear with respect to energy required. To perform at peak efficiency, a nonlinear mechanism is necessary.

In operation, gas from the storage container O is introduced to the compression cylinder 204 via conduit 211, port 212 and check valve 213. At the same time, driving gas is supplied to the driving or motor piston 201, via conduit 214, metering valve 215, and the variable capacitance chamber 217. As gas is metered through the metering device 215 at a substantially constant rate, it accumulates in the capacitance chamber 217 until the necessary energy is built up. During this procedure, annular seal 223, located on the piston 201, seals against seat 224 provided around the entrance of conduit 214 into the cylinder 202.

When the required energy is accumulated, the seal 223 is unseated from seat 224 and the gas accumulated within capacitance chamber 217 enters the driving cylinder 202 expanding substantially adiabatically and moving the driving or motor piston 201 from its first terminal position to its second terminal position, essentially at the opposite end of cylinder 202. Of course, as the piston 201 moves, the smaller compression cylinder piston 203 moves from its first terminal position to its second terminal position, compressing the gas within the cylinder 204 and transferring it via check valve 210 to the high pressure container X.

At the end of the compression cycle, the pressure within the cyliner 202 will have decreased to a value which will allow the pressure within the cylinder 204 to force the pistons 203 and 201 to return to their first terminal positions. As this is done, the expanded gas within the driven or motor cylinder 202 will exit through vents 228 and 225 into the cabin environment E for use therein. The cycle is then repeated.

Although three embodiments of the invention have been described, other variations thereof can be made by those skilled in the art without departing from the spirit of the invention. Furthermore, applications other than space vehicles will be apparent. For example, the apparatus of the present invention could be easily adapted for filling oxygen bottles in an underwater habitat for use by divers. Many variations and uses of the invention can be devised by those skilled in the art. Therefore, it is intended that the scope of the invention be limited only the claims which follow.

What is claimed is:

1. A method of transferring gas from a first container at a lower pressure level to a second container at a higher pressure level utilizing a free piston compressor having a driving piston and cylinder, a smaller diameter driven piston and cylinder, and a rod connecting said driving and driven pistons for mutual reciprocation in their respective cylinders between first and second terminal positions, said method comprising the steps of:

a. supplying gas from said first container to said driven piston and cylinder;

b. accumulating gas from said first container in a capacitance chamber until a predetermined pressure has been achieved;

c. intermittently releasing said accumulated gas from said capacitance chamber for introduction into said driving cylinder when said predetermined pressure has been exceeded; and d. allowing said accumulated gas to expand in said driving cylinder to move said driving and driven pistons from said first to said second terminal positions, thereby compressing the gas within said driven cylinder for transfer to said second container.

2. The method of claim 1 in which said gas expansion in said driving cylinder is substantially adiabatic.

3. The method of claim 1 and the further step of:

exhausting said expanded gas from said driving cylinder of movement of said pistons from said second to said first terminal positions.

4. The method of claim 3 in which said exhausting is to a controlled environment, at least a portion of which is made up of said gas, the amount of said gas being fed to said capacitance chamber being controlled to provide the amount required for said controlled environment.

5. Apparatus for transferring fluid from a low pressure to a higher pressure comprising:

a. a source of fluid under low pressure;

b. a receiver for receiving fluid under high pressure;

c. a first cylinder adapted to receive fluid from said low pressure source;

d. a second cylinder, of smaller diameter an said first cylinder, adapted to receive fluid from said low pressure source and to deliver fluid to said receiver at a high pressure;

e. first and second pistons rigidly connected to each other by a rod and adapted to reciprocate simultaneously within said first and second cylinders respectively;

f. first vent means in said first cylinder and located on the rod side of said first piston for continuous communication with the ambient environment;

g. first conduit means for supplying fluid from said low pressure source to said first cylinder;

h. second conduit means for supplying fluid from said low pressure source to said second cylinder;

i. third conduit means for delivering fluid at high pressure from said second cylinder to said receiver;

j. capacitance means located in said first conduit means for receiving and storing fluid at low pressure;

k. control means located between said capacitance means and said first cylinder and responsive to the pressure within said capacitance means and said receiver for intermittently releasing fluid from said capacitance means for expansion against the face of said first piston; and, 1. second vent means in said first cylinder and located on the face side of said first piston for exhausting said intermittently introduced fluid after expansion against the face of said piston.

6. Apparatus as set forth in claim 5 in which said control means comprises a valve which is also connected to said receiver and which valve is responsive to the differential pressure between said capacitance means and said receiver for controlling the intermittent fluid release from said capacitance means.

7. Apparatus as set forth in claim 5 in which said capacitance means comprises a chamber into which fluid is fed at a relatively low rate for accumulation and then intermittent release in response to operation of said control means.

8. Apparatus as set forth in claim 5 additionally comprising metering means in said first conduit means for controlling the rate at which fluid is fed to said capacitance means for accumulation and then intermittent release into said first cylinder.

9. Apparatus as set forth in claim 8 in which said second vent means is connected to a controlled environment, at least a portion of which is made up of said fluid, said metering means being adjustable for controlling the amount of fluid vented to said atmosphere through said second vent means.

10. Apparatus as set forth in claim 5 in which said second vent means comprises an orifice, and additionally comprising a second orifice in said first conduit means, between said first cylinder and said control means for maintaining pressure on said control means, during said intermittent release of fluid, sufficient to assure complete reciprocation of said driving piston.

11. Apparatus as set forth in claim 5 in which said second vent means comprises a valve which opens in response to pressures below a predetermined amount to permit said expanded fluid to exit.

12. Apparatus as set forth in claim 11 in which said valve is provided with means engageable by said first piston during initial and terminal stages of reciprocation cycle to maintain said valve in a closed position.

13. Apparatus as set forth in claim 5 in which said control means comprise a valve having a first pressure area, against which the pressure within said capacitance means acts when said valve is closed, and a large pressure area against which the pressure within said capacitance means acts when said valve is open.

14. Apparatus as set forth in claim 5 in which said capacitance means comprising a cylindrical chamber having a first portion of one diameter and a second portion of a smaller diameter and in which said control means comprises a piston assembly having a first piston for reciprocation in said first chamber portion rigidly connected by a rod to a smaller diameter piston member for reciprocation in said smaller capacitance chamber portion, one of said piston members being subjected to the pressure within said receiver and said other piston member being subjected to a biasing means for controlling the accumulation of energy within said capacitance means and intermittent release of fluid therefrom for introduction into said first cylinder.

15. Apparatus as set forth in claim 5 in which said capacitance means comprises a variable volume chamber and means within said chamber, subjected to pressure within said receiver, for varying the volume of said capacitance chamber in response to the pressure within said receiver.

16. Apparatus as set forth in claim 5, in which said second conduit means is connected to the rod side of said second piston, said second piston being provided with a port and check valve through which gas is introduced to the opposite side of said driven piston for compression and transfer.

* * * * *